United States Patent [19]

Appleby et al.

[11] 4,407,908

[45] * Oct. 4, 1983

[54] CATHODE FOR AN ELECTROLYSER

[75] Inventors: Anthony J. Appleby, Boulogne; Gilles Crepy, Evry, both of France

[73] Assignee: Compagnie Generale d'Electricite, Paris, France

[ * ] Notice: The portion of the term of this patent subsequent to Feb. 5, 1997 has been disclaimed.

[21] Appl. No.: 8,443

[22] Filed: Feb. 1, 1979

[51] Int. Cl.[3] ..... H01M 4/52; C25B 11/04

[52] U.S. Cl. ..... 429/45; 204/290 R; 204/291

[58] Field of Search ..... 204/291, 290 R, 290 L; 429/45

[56] References Cited

U.S. PATENT DOCUMENTS 3,282,808 11/1966 Kandler ..... 204/290 R X
4,080,278 3/1978 Ravier et al. ..... 204/242

FOREIGN PATENT DOCUMENTS 1592294 6/1970 France ..... 429/45

*Primary Examiner*—F. Edmundson
*Attorney, Agent, or Firm*—Sughrue, Mion, Zinn, Macpeak & Seas

[57] ABSTRACT

A cathode for an electrolyser. It comprises porous conductive material which includes sintered nickel impregnated with a catalyst, characterized in that said catalyst is a molybdate of nickel or iron or mixtures thereof. The invention is used for manufacturing hydrogen by electrolysing an aqueous alkaline solution.

2 Claims, No Drawings

CATHODE FOR AN ELECTROLYSER

FIELD OF THE INVENTION

The present invention relates to a cathode for an electrolyser having a basic solution, in particular an aqueous solution of the type in which oxygen is evolved at the anode and hydrogen is evolved at the cathode.

It also relates to a method which is suitable for producing such an electrode.

BACKGROUND OF THE INVENTION

In known electrolysers which operate at ambient temperature and pressure or at a temperature and a pressure greater than ambient temperature and pressure, it is observed that the operating characteristics fluctuate as a function of time. In particular, the voltage required for electrolysis fluctuates.

In a case where a basic electrolyte is used, such fluctuations result from the variation in structure of the electrodes and in particular of the cathode, these variations resulting from attack by said electrolyte, especially when electrolysis is carried out at a temperature higher than ambient temperature.

The present invention aims to mitigate the above-outlined drawback and relates to a cathode for a basic solution electrolyser.

SUMMARY OF THE INVENTION

The invention provides a cathode for an electrolyser, said cathode comprising a porous conductive material which includes sintered nickel impregnated with a catalyst, comprising a molybdate of at least one metal chosen from the group which includes nickel, iron and mixtures thereof.

Advantageously, the ratio by weight between said molybdate and sintered nickel lies substantially between 20 and 40%.

The invention also provides a method of preparing a cathode, wherein a sintered nickel support is impregnated by at least a first immersion in an aqueous solution of a soluble derivative of molybdenum suitable subsequently for being thermally decomposed into molybdenum oxide, and a second immersion in a solution of at least one salt of nickel or iron, said second immersion being followed by heating in a hydrogen atmosphere and at a temperature of about 450° C.

DESCRIPTION OF THE PREFERRED EMBODIMENT

An embodiment of the invention is described in greater detail by way of example.

A cathode embodying the invention is produced as described hereinbelow.

Firstly, the following mixture is formed:

Nickel powder 1000 g
Carboxymethylcellulose 14.5 g
Water 1 liter

The particle size of the nickel powder used is in the order of 5 microns and is obtained by thermal cracking of nickel tetracarbonyl, $Ni(CO)_4$.

A thick paste is thus obtained and is coated on an expanded conductor plate made of stainless steel, for example.

After drying, sintering is effected in a hydrogen atmosphere at a temperature lying between 800° and 1000° C. and maintained for 10 minutes to 1 hour, not including the rise and fall of the temperature.

The sintering temperature is preferably maintained at 950° C. for 30 minutes.

Then, the material obtained above is impregnated with a catalyst.

For this purpose, said material is immersed in an aqueous ammonium molybdate solution in a concentration equivalent to 2 moles per liter of molybdenum trioxide which decomposes into molybdenum dioxide or trioxide on subsequent heating. After immersion, the material is heated for 1 to 2 hours in air at a temperature which lies between 200° and 900° C., and which is preferably 450° C.

The material is then impregnated a second time, this time in a nickel nitrate or iron nitrate solution or mixtures thereof and then undergoes heat treatment in a hydrogen atmosphere and at a temperature close to 450° C. One variant consists in performing the two immersions simultaneously, in an aqueous solution of ammonium molybdate mixed with nickel nitrate or iron nitrate or a mixture thereof. Advantageously, the material is dehydrated such as by being lyophilized (freeze dried) at low temperature in a vacuum before being heated in a non-reducing atmosphere.

A cathode is thus obtained which is suitable for producing hydrogen and oxygen in an electrolyser having an aqueous basic solution.

Such a cathode is made of sintered nickel whose porosity lies between about 30 and 50%, and which is impregnated with nickel molybdate or iron molybdate or a mixture thereof in a quantity such that the ratio by weight between the molybdate and nickel preferably lies substantially between 70 and 40%.

Such a cathode provides very stable operation of the electrolyser, in particular at temperatures in the order of 160° C. without danger of corrosion by the basic electrolyte.

The anode could be of any known type, but advantageously, it will be of the type described by the Applicant in United States patent application Ser. No. 824,508 entitled "An electrolyser for basic solutions", filed Aug. 17, 1977, now U.S. Patent 4,184,930.

To give a clear idea, such a cathode, when used in an electrolyser having an anode in accordance with said application Ser. No. 76 25 579, did not show appreciable variation after 100 days' operation.

An electrolyser using a cathode in accordance with the invention can advantageously be applied to manufacturing hydrogen by electrolysing an aqueous alkaline solution.

We claim:

1. A cathode for an electrolyser, said cathode comprising a porous conductive material which includes sintered nickel impregnated with a catalyst, said catalyst comprising a molybdate of at least one metal chosen from the group consisting of nickel, iron and mixtures thereof, wherein the ratio of weight between the molybdate and the sintered nickel lies substantially between 20 and 40%.

2. A cathode according to claim 1, wherein the porosity of the porous conductive material lies substantially between 30 and 50%.

* * * * *